US006070497A

United States Patent [19]

Farelli

[11] Patent Number: 6,070,497

[45] Date of Patent: Jun. 6, 2000

[54] MULTIPURPOSE IMPLEMENT FOR OPENING CONTAINERS FOR FOODSTUFFS AND OTHER PRODUCTS

[76] Inventor: Cesare Farelli, Via Boticelli, No. 31, I-10155 Turin, Italy

[21] Appl. No.: 09/195,281

[22] Filed: Nov. 18, 1998

[30] Foreign Application Priority Data

Nov. 21, 1997 [IT] Italy ..... TO97A1019

[51] Int. Cl.[7] ..... B67B 7/44

[52] U.S. Cl. ..... 81/3.09; 81/3.4; 81/3.55

[58] Field of Search ..... 81/3.09, 3.4, 3.55, 81/3.57; D8/33, 40

[56] References Cited

U.S. PATENT DOCUMENTS

| | | | |
|---|---|---|---|
| 2,568,612 | 9/1951 | Cullen | 81/3.09 X |
| 3,570,028 | 3/1971 | De La Hitte | 81/3.4 |
| 4,633,740 | 1/1987 | Jacobs | 81/3.09 |
| 4,967,622 | 11/1990 | Phillips | 81/3.09 |

FOREIGN PATENT DOCUMENTS

| | | | |
|---|---|---|---|
| 3631705 | 3/1988 | Germany | 81/3.09 |
| 372168 | 3/1973 | U.S.S.R. | 81/3.09 |

*Primary Examiner*—D. S. Meislin
*Attorney, Agent, or Firm*—Levine & Mandelbaum

[57] ABSTRACT

A multipurpose implement for opening containers for foodstuffs and other products has one end with a ring and tab for removing lift-off bottle caps, an opposite end with an outer edge having a hook, a lug and serrations for opening cans, and an intermediate portion having an oval aperture with additional serrations, for twisting off caps and lids.

6 Claims, 4 Drawing Sheets

MULTIPURPOSE IMPLEMENT FOR OPENING CONTAINERS FOR FOODSTUFFS AND OTHER PRODUCTS

SUMMARY

Multipurpose implement for opening containers for foodstuffs and other products, stamped in a single piece of adequate thickness, preferably made of stainless steel plate, comprising one end or handle having the shape of a ring (2) with a tab (3), a central part with an oval-shaped hole (7), the edge of which presents two portions (8, 9) having toothed profiles, with a tab bent back (10) above the hole, the other end being provided with a lug (4), a hook (5) and a toothed curved outer profile (6).

It is well known that the consumer frequently encounters difficulties when opening containers for foodstuffs or other products, in particular metal tins or cans and bottles made of glass or thermoplastic material.

Such operations frequently result in the contents getting spilled in an uncontrolled way, or else may be the cause of accidents involving the user.

Likewise known is the use of appropriately designed implements for the above-mentioned operations, which, however, present the following drawbacks:

- they do not guarantee maximum efficiency from the functional point of view;
- their use is normally aimed at the opening of a single type of container;
- they are complex and laborious to manufacture, with consequent high production costs;
- frequently they are cumbersome.

The main purpose of the invention is to eliminate the drawbacks mentioned above.

The present invention, as it is characterized by the claims, solves the problem of producing a multipurpose implement for opening containers for foodstuffs or other products which achieves the following results:

- multipurpose use for opening metal tins or cans, screw tops and/or metal crown caps for bottles made of glass or thermoplastic material;
- considerable efficiency from the functional point of view;
- maximum safety from the standpoint of accident prevention;
- ease of manufacture, with consequent contained economic cost;
- small overall dimensions, above all if compared to its multipurpose characteristics.

Additional and more extensive characteristics of the invention are described in what follows, with reference to the attached drawings, in which:

FIG. 1 is a perspective view of the implement stamped in a single piece;

FIG. 2 presents a perspective view of the use of the implement in opening a metal crown cap on a hermetically closed bottle;

Figure 6:
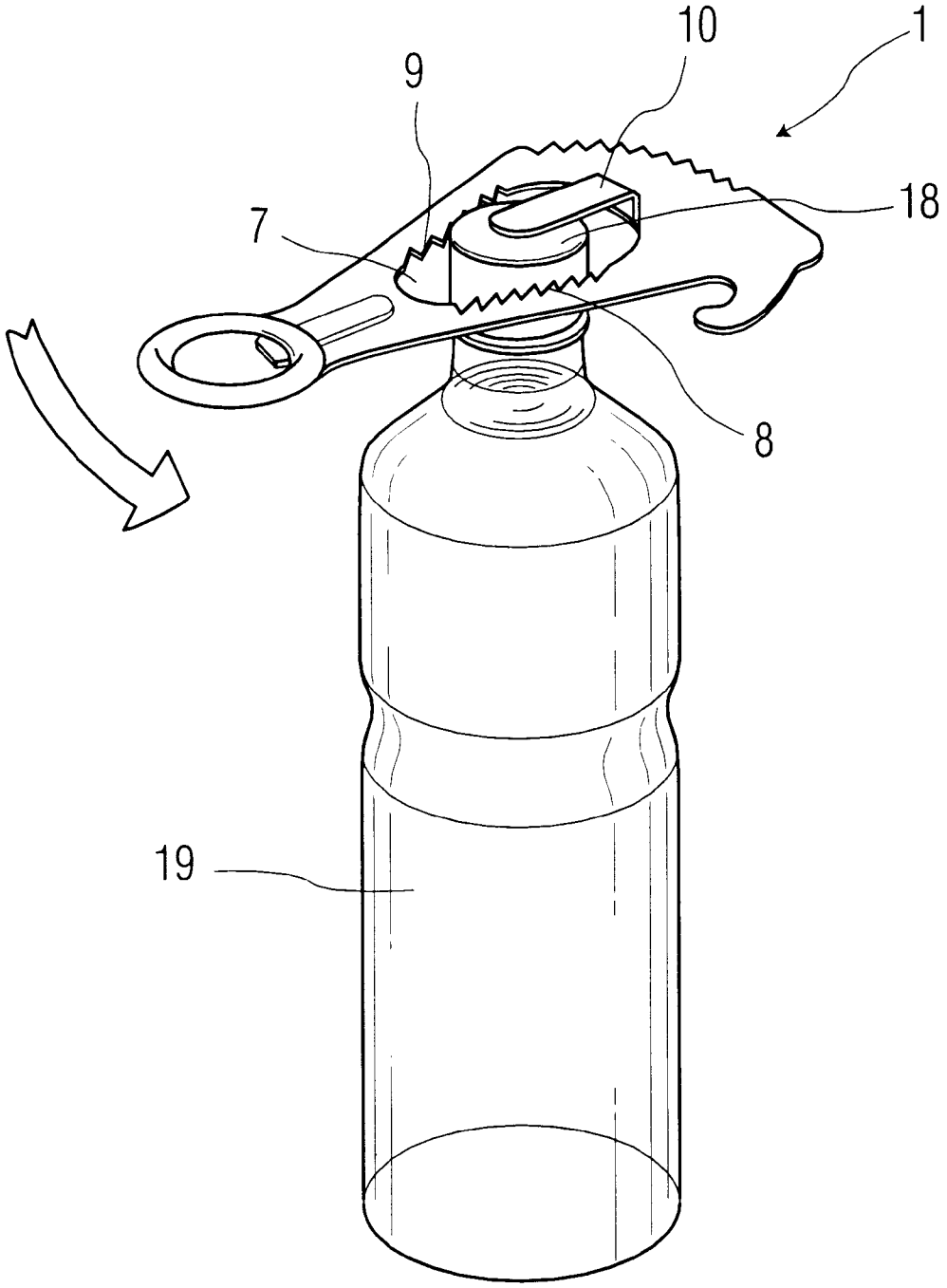

FIG. 6 presents a perspective view of the use of the implement in the subsequent phase of opening of the screw top of a bottle made of glass or thermoplastic material.

Figure 1:
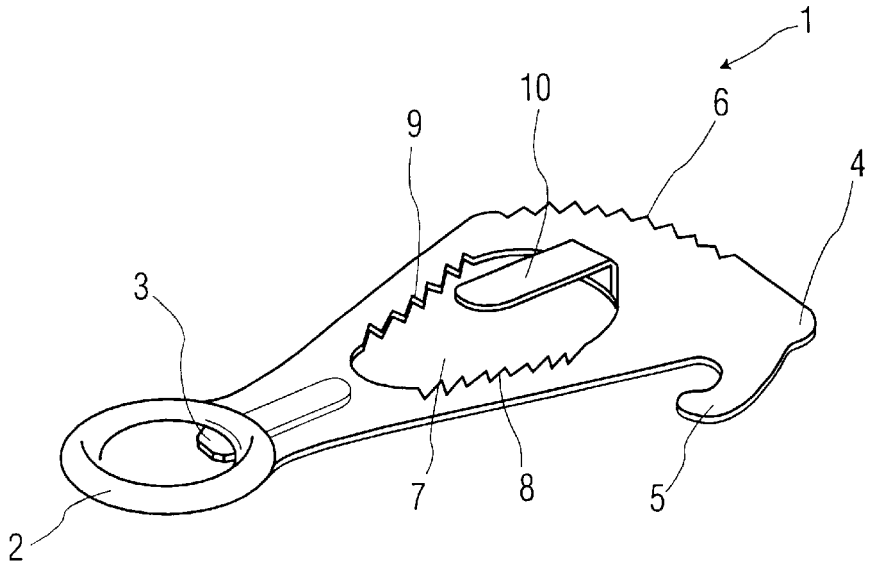

With reference to FIG. 1, and in accordance with the invention, the multipurpose implement 1, stamped in a single piece and preferably made of stainless steel plate using a special press, comprises one end shaped like a ring 2 with a tab 3 used for opening the pressure caps on bottles, with the additional function of handle for favouring the carrying out of the other functions described in what follows.

The opposite end consists of a lug 4, a hook 5, and presents a toothed curved outer profile 6, all of which for opening lids of metal tins and/or cans.

In the central area is made an oval hole 7 with the two opposite ends having different radiuses of curvature and two toothed portions 8 and 9, both with the teeth facing in the left-hand direction of rotation of the implement, on the top of which is located a tab 10, all these parts being used for the opening of screw tops of bottles made of glass or thermoplastic material.

Figure 2:
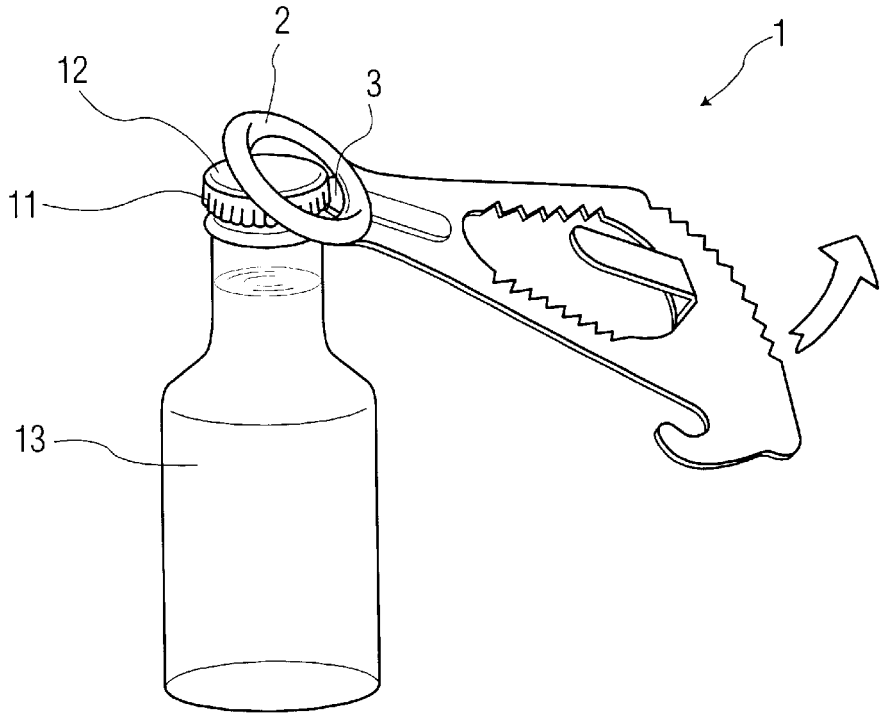
Figure 3:
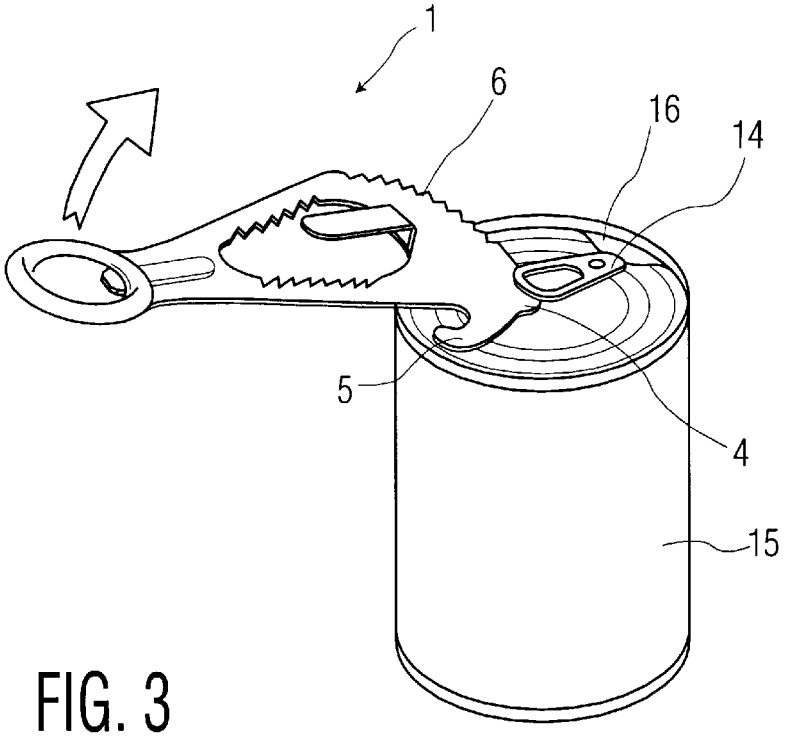
FIG. 3 illustrates a perspective view of the use of the implement for partial lifting of the tab for tearing off the lid of a metal tin and/or can.
Figure 4:
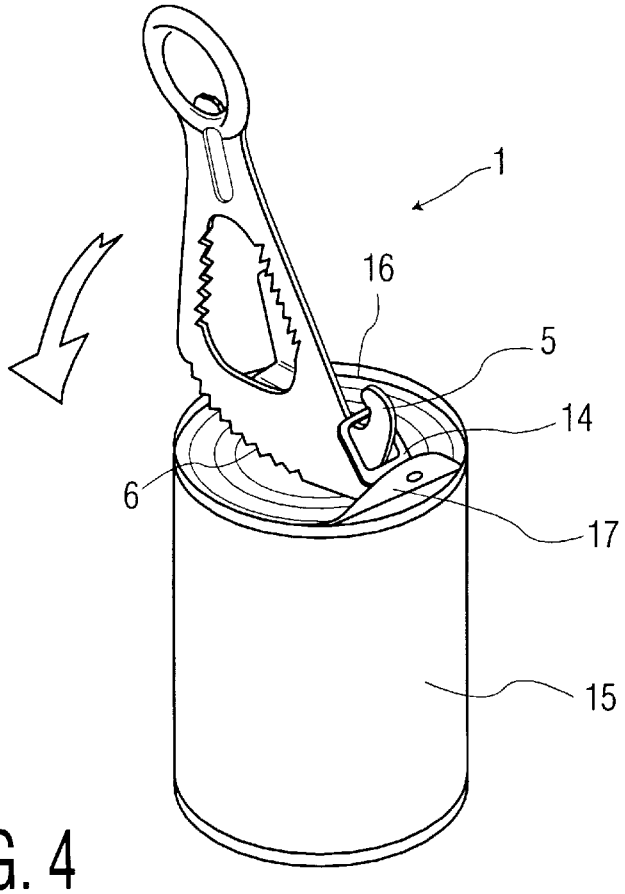
FIG. 4 is again a perspective view of the use of the implement in the subsequent phase of opening the lid of the metal tin and/or can.
Figure 5:
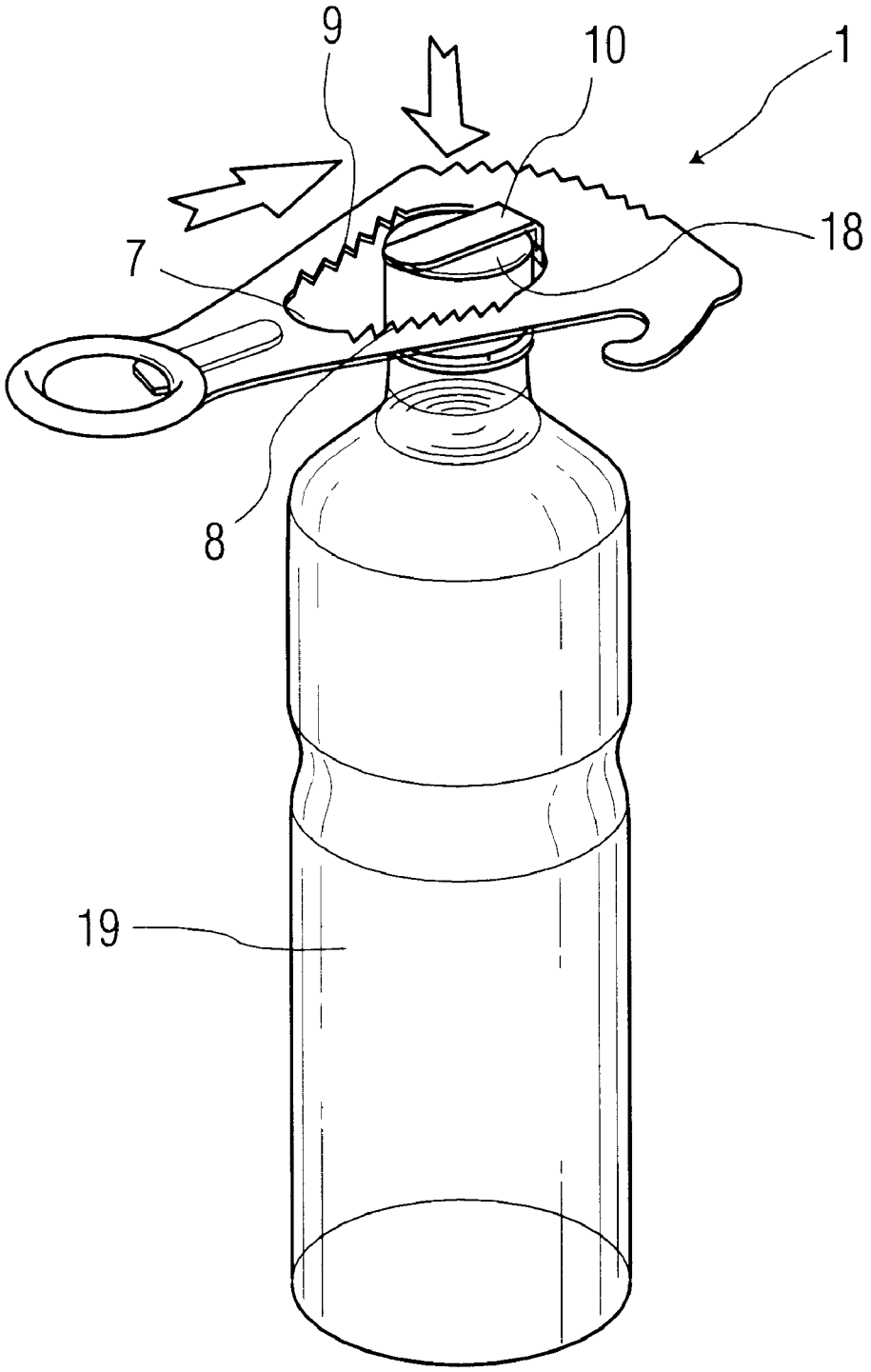
FIG. 5 is a perspective view of how the implement is set for opening the screw top of a bottle made of glass or thermoplastic material.

Basically, the use of the multipurpose implement is as follows:

1. Opening of metal crown caps of hermetically closed bottles (FIG. 2)
   - Position the implement 1 so as to engage at the same time the bottom edge of the crown 11 of the cap 12 with the tab 3 of the implement, and the top of the cap with the ring-shaped part 3 of the implement.
   - Rotate the implement upwards until the cap 12 is removed from the bottle 13.
2. Tearing off lids of metal tins and/or cans (FIGS. 3 and 4)
   - With the lug 4, partially lift the tab 14 of the tin or can 15.
   - Position the implement so as to insert its hook 5 in the said tab 14.
   - Rotate the implement vertically (downwards); as a result of its curved outer profile, the implement engages the raised edge 16 of the tin or can 15 with its teeth, until the lid 17 is completely torn open.
3. Opening of screw tops of bottles made of glass or thermoplastic material (FIGS. 5 and 6)
   - Engage the larger end of the oval hole 7 of the implement 1 on the screw top 18 of the bottle 19 so that the upper tab 10 rests against the screw top 18. The said bent-back tab 10 has the purpose both of facilitating the entire operation of opening of the bottle and that of constraining the grip of the teeth 8 and 9 in a central position, i.e., at about one half of the height of the screw top 18.
   - Slide the implement 1 forwards so that the two toothed portions 8 and 9 engage the screw top 18, and at the same time rotate the implement itself in the left-hand direction until complete opening of the top is achieved.

The features of the implement described above may be summarized as follows:

- multipurpose use for opening metal tins or cans, screw tops and or metal crown caps of bottles made of glass or thermoplastic material or metal;
- considerable efficiency from the functional standpoint;
- maximum safety from the accident-prevention standpoint;
- ease of manufacture, with consequent contained economic cost;
- small overall dimensions, above all if compared with its multiple features of use.

What is claimed is:

1. Multipurpose implement (1) for opening containers for foodstuffs and other products, stamped in a single piece comprising one end having the shape of a ring (2) with a tab (3), a central part with an oval-shaped hole (7), the edge of which presents two toothed portions (8, 9), with a bent back tab (10) above the hole, and an opposite end comprising a lug (4), a grasping member (5) and a toothed curved outer profile (6).

2. Multipurpose implement according to claim 1, wherein the oval-shaped hole (7) has opposite ends with two different radiuses of curvature.

3. Multipurpose implement according to claim 1 wherein the two toothed portions (8, 9) both have teeth facing for grasping upon counterclockwise rotation of the implement.

4. Multipurpose implement according to claim 1 wherein the distance of the tab(10) with respect to the implement corresponds to about one half the height of a screw cap (18) for a bottle.

5. Multipurpose implement according to claim 1, wherein the grasping member (5) is shaped like a hook.

6. Multipurpose implement according to claim 1 wherein an outer edge of the opposite end has said toothed curved profile (6) in order to engage the raised edge (16) of a tin or can (15) during opening of a lid (17).

* * * * *